US005606874A

United States Patent [19]

Archetti et al.

[11] Patent Number: 5,606,874

[45] Date of Patent: Mar. 4, 1997

[54] DETACHABLE JEWELRY ORNAMENTATION

[75] Inventors: Barbara Archetti, Princeton, N.J.; Varin Assamongkorn, Bangkok, Thailand

[73] Assignee: Kurt Gutmann Jewelry, Inc., Newtown, Pa.

[21] Appl. No.: 617,436

[22] Filed: Mar. 18, 1996

[51] Int. Cl.[6] ..... A44C 1/00

[52] U.S. Cl. ..... 63/21; 63/23; 63/3.1

[58] Field of Search ..... 63/2, 3, 4, 21, 63/22, 23, 29.1, 31, 27; 24/564

[56] References Cited

U.S. PATENT DOCUMENTS

| | | | |
|---|---|---|---|
| 2,107,684 | 2/1938 | Bangs . | |
| 2,763,999 | 9/1956 | Norman . | |
| 3,483,716 | 12/1969 | Stenzler . | |
| 3,529,373 | 9/1970 | Aaskov . | |
| 3,733,851 | 5/1973 | D'Apuzzo . | |
| 4,218,894 | 8/1980 | Tropea . | |
| 4,305,262 | 12/1981 | Ferrara . | |
| 4,542,630 | 9/1985 | Nanasi et al. . | |
| 4,551,993 | 11/1985 | Nagahori . | |
| 4,754,534 | 7/1988 | Helwick | 63/2 X |
| 4,796,442 | 1/1989 | Sarcona . | |
| 4,977,757 | 12/1990 | Mesica et al. . | |
| 5,022,237 | 6/1991 | Monderer . | |
| 5,228,317 | 7/1993 | Hendricks . | |
| 5,440,900 | 8/1995 | White . | |

*Primary Examiner*—Kien T. Nguyen
*Attorney, Agent, or Firm*—Sperry, Zoda & Kane

[57] ABSTRACT

A jewelry ornamentation device that is selectively securable with respect to a basically conventional substrate jewelry such as a necklace, bracelet, ankle bracelet or the like. The detachable jewelry device includes a base plate and a clamping arm pivotally secured to one another and a clasping device for selectively securing the to one another. A compression member of flexibly resilient material is mounted between the movable members and is retained in position by a positioning device preferably in the form of two posts extending upwardly in the holes defined in the compression member to facilitate securement in position on the clamping surface of the base plate member. With the substrate jewelry extending positioned adjacent to the compression member, the ornamentation securable to the clamping arm can be fixedly secured with respect to the substrate jewelry at any chosen location by securement of the clasping apparatus.

20 Claims, 2 Drawing Sheets

DETACHABLE JEWELRY ORNAMENTATION

BACKGROUND OF THE INVENTION

1. Field of the Invention

The present invention deals with the field of jewelry constructions generally and specifically deals with movably positionable jewelry wherein the ornamentation and decoration displayed by the jewelry can be modified as desired by the user with certain prescribed possibilities. The design of the present invention includes an ornamentation means mounted with respect to the movable jewelry element wherein the jewelry element itself can be attached at multiple locations with respect to conventionally designed and configured necklaces, bracelets and the like.

2. Description of the Prior Art

The present invention relates to the field of devices for providing movable or an adjustably positionable jewelry and attempts to achieve such design heretofore as shown in U.S. Pat. No. 2,107,684 issued Feb. 8, 1938 to R. D. Bangs and assigned to Cohn & Rosenberger, Inc. on a "Monogram Construction"; and U.S. Pat. No. 2,763,999 issued Sep. 25, 1956 to F. Norman on "Earring Pads With Expansible Opening For Attaching To Earring"; and U.S. Pat. No. 3,483,716 issued Dec. 16, 1969 to G. Stenzler on a "Personal Ornament With Mounting And Indexing Means For Centering Varied Numbers Of Jewel Settings"; and U.S. Pat. No. 3,529,373 issued Sep. 22, 1970 to H. Asskov on "Multi-Design Jewelry"; and U.S. Pat. No. 3,733,851 issued May 22, 1973 to L. D'Apuzzo and assigned to H. Goodman & Sons, Inc. on "Gems In Linked Settings And Mechanically Secured To A Base Member"; and U.S. Pat. No. 4,218,894 issued Aug. 26, 1980 to A. Tropea and assigned to Lang Jewelry Company on a "Pierced Earring With Adjustable Ornament"; and U.S. Pat. No. 4,305,262 issued Dec. 15, 1981 to C. Ferrara on "Jewelry With Slidable, Add-On Gems"; and U.S. Pat. No. 4,542,630 issued Sep. 24, 1985 to J. Nanasi et al and assigned to Nei Gold Products Inc. on a "Decorative Ornament For A Band Or Chain"; and U.S. Pat. No. 4,551,993 issued Nov. 12, 1985 to M. Nagahori and assigned to Kabushiki Kaisha Nagahori on a "Necklace With Slidably Mounted Decorative Element"; and U.S. Pat. No. 4,796,442 issued Jan. 10, 1989 to A. Sarcona and assigned to Sarcona Bros. on an "Item Of Jewelry Including A Gem Slidable Within A Gem Insert"; and U.S. Pat. No. 4,977,757 issued Dec. 18, 1990 to Z. Mesica et al and assigned to Prestige Collection, Inc. on "Jewelry With Rotatable Ornamentation"; and U.S. Pat. No. 5,022,237 issued Jun. 11, 1991 to T. Monderer et al and assigned to Superior Diamond Corporation on an "Attachment Apparatus To Removably Retain A Charm On A Bracelet Without Obstructing The View Of Gemstones On The Bracelet"; and U.S. Pat. No. 5,228,317 issued Jul. 20, 1993 to B. Hendricks and assigned to Hendricks and Bayhi on a "Gem Changer Ring"; and U.S. Pat. No. 5,440,900 issued Aug. 15, 1995 to Howard White and assigned to Omega Casting Corp. on "Add-On Jewelry Item For Flexible Jewelry Chains".

SUMMARY OF THE INVENTION

The present invention provides a detachable jewelry ornamentation device which is securable selectively at a number of different locations decoratively with respect to a substrate jewelry member such as a necklace or bracelet design or the like. The detachable jewelry ornamentation device includes a base plate which defines a base clamping surface extending thereon and includes a first base plate end and a second base plate end which are positioned apart from one another with the base clamping surface preferably positioned therebetween.

A clamping arm member is also defined pivotally secured with respect to the base plate member. This clamping arm member preferably includes a first clamping arm and a second clamping arm which are spaced apart from one another and preferably are separated by an arm clamping surface positioned therebetween on the clamping arm member. The arm clamping surface of the second clamping arm is positioned facing the base clamping surface at the base plate member and is spatially disposed therefrom in such a manner as to define a clamping zone therebetween. The first clamping arm end of the clamping arm member is preferably pivotally attached with respect to the first base plate of the base clamping member in order to facilitate movable attachment therebetween. The clamping arm member is preferably arcuate and the clamping arm surface is preferably of a concave shape in order to further facilitate retaining of a substrate jewelry member thereadjacent. The clamping arm member also preferably defines an ornamentation groove extending therearound to facilitate ornamentation and/or decoration thereof.

A compression member is preferably provided of a resiliently flexible material such as rubber or foam rubber and is positioned on the base clamping surface within the clamping zone in order to exert a resilient bias upon any substrate jewelry which is positioned within the clamping zone. In this manner the compression member will serve to affix the base plate member and the clamp arm member detachably with respect to the substrate jewelry member as desired. Preferably the compression member will define a hole means extending therein to facilitate positioning thereof.

A positioning device preferably is included which is affixed to the base clamping surface of the base member and is in abutment with respect to the compression member in order to fixedly position it with respect to the base clamping surface within the clamping zone. In this manner retainment of the substrate jewelry member within the clamping zone will be achieved.

The positioning device preferably includes a post means comprising more particularly a first post member and a second post member positioned adjacent to one another and extending outwardly from the base clamping surface into the clamping zone and positioned extending into the holes defined in the compression member to facilitate mounting of the compression member with respect to the positioning member.

A primary ornamentation apparatus is attachable to preferably an ornamentation groove defined in the clamping arm member in order to facilitate decoration of the substrate jewelry member. An adhesive means may also be included positioned between the compression member and the base clamping surface of the base plate member in order to further maintain securement of the compression member in place mounted on the base clamping surface.

A clasping apparatus is preferably included for detachably securing the clamping arm member with respect to the base plate member. This clasping apparatus is adapted to secure the second clamp arm end detachably with respect to the second base plate and to compress the compression member positioned within the clamping zone therebetween and detachably retain a substrate jewelry member securely.

This clasping apparatus preferably further includes two primary locking members defined as the primary locking apparatus and the secondary locking apparatus. The primary locking apparatus preferably includes a primary locking tab extending outwardly from the clamping arm member and being integrally affixed with respect to the second clamping arm end of the clamping arm member. The primary locking apparatus further preferably includes a primary locking slot defined in the base plate member adjacent the second clamping arm end. This primary locking slot is preferably adapted to receive the primary locking tab extending therein to achieve primary locking of the clamping arm member with respect to the base plate member with a substrate jewelry member positioned therebetween within the clamping zone. The primary locking slot is preferably tapered to facilitate detachable securement with respect to the primary locking tab.

A secondary locking device is also preferably included which includes an L-shaped bracket member pivotally secured with respect to the second clamping arm end and extending outwardly therefrom. This L-shaped bracket member defines a securement notch therein preferably in this preferred configuration. A secondary locking slot is also defined in the base plate member adjacent the second base plate end thereof. This L-shaped bracket is preferably engageable therethrough to provide the secondary locking securement. A secondary locking shoulder may also be included extending from the base plate member approximately perpendicularly with respect to the cross section of the secondary locking slot. This securement notch of the L-shaped bracket will preferably be selectively engageable with respect to the secondary locking shoulder responsive to the L-shaped bracket being in position extending through the secondary locking slot means in such a manner as to facilitate detachable auxiliary securement of the clamping arm member with respect to the base plate member by the secondary locking means.

It is an object of the present invention to provide a detachable jewelry ornamentation means securable selectively at various locations decorative with respect to a substrate jewelry member wherein attachment with respect to many different types of substrate jewelry is possible.

it is an object of the present invention to provide a detachable jewelry ornamentation means securable selectively at various locations decorative with respect to a substrate jewelry member wherein attachment with respect to most necklaces is achievable.

It is an object of the present invention to provide a detachable jewelry ornamentation means securable selectively at various locations decorative with respect to a substrate jewelry member wherein attachment with respect to most wrist and ankle bracelets is achievable.

It is an object of the present invention to provide a detachable jewelry ornamentation means securable selectively at various locations decorative with respect to a substrate jewelry member wherein the number of moving parts is minimized.

It is an object of the present invention to provide a detachable jewelry ornamentation means securable selectively at various locations decorative with respect to a substrate jewelry member wherein the initial capital cost outlay for manufacture and sale of the product is minimized.

It is an object of the present invention to provide a detachable jewelry ornamentation means securable selectively at various locations decorative with respect to a substrate jewelry member wherein maintenance requirements are minimized.

It is an object of the present invention to provide a detachable jewelry ornamentation means securable selectively at various locations decorative with respect to a substrate jewelry member wherein construction of a soft metallic material such as gold is feasible.

It is an object of the present invention to provide a detachable jewelry ornamentation means securable selectively at various locations decorative with respect to a substrate jewelry member wherein decoration of the substrate jewelry can be significantly modified by usage thereof.

It is an object of the present invention to provide a detachable jewelry ornamentation means securable selectively at various locations decorative with respect to a substrate jewelry member wherein firm double-locking clasping is provided to prevent loss of jewelry.

It is an object of the present invention to provide a detachable jewelry ornamentation means securable selectively at various locations decorative with respect to a substrate jewelry member wherein operation of the clasping apparatus including the first and second locking means is easily done.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
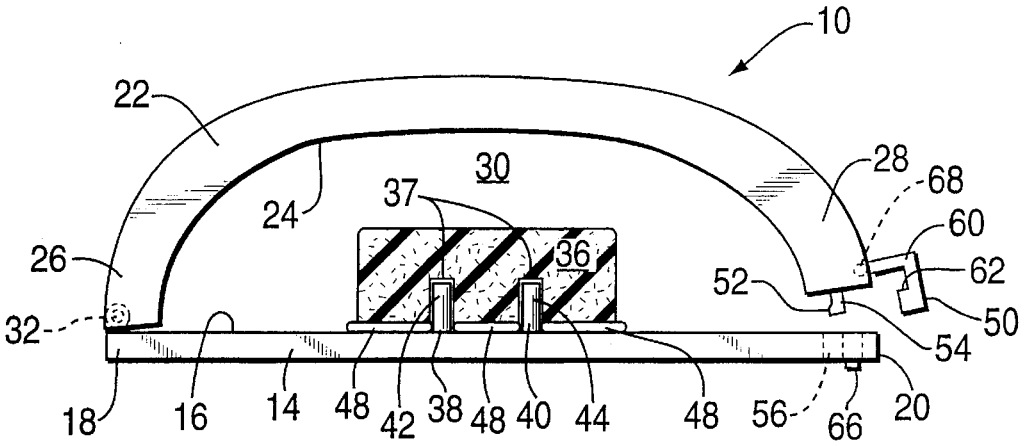
FIG. 1 is a front cross-sectional view of an embodiment of the detachable jewelry ornamentation means of the present invention.

The present invention shows a jewelry ornamentation means 10 which is detachably securable with respect to a substrate jewelry member 12 such as a necklace, wrist bracelet, ankle bracelet, and the like.

The basic construction includes a base plate member 14 with a clamping arm member 22 pivotally secured thereto by a pivotal connection 32. The base plate member 14 preferably is flat and includes a first base plate end 18 at one end thereof and a second base plate end 20 at the opposite end thereof spaced apart from one another. Base plate member 14 preferably also defines a base clamping surface 16 positioned between the first end 18 and the end 20 thereof.

The construction of the clamping arm member 22 includes a first clamping arm end 26 which is preferably pivotally connected at the pivotal connection 32 with respect to the first base plate end 18 of the base plate member 14. Clamping arm member 22 also includes a second clamping arm end 28 spatially distant from the first clamping arm end 26 thereof. An arm clamping surface 24 is preferably positioned between the first clamping arm end 26 and the second clamping arm end 28.

In the preferred configuration the clamping arm member 22 is of an arcuate configuration to facilitate the clamping of the jewelry substrate member 12 positioned between the clamping arm member 22 and the base plate member 14. With this arcuate configuration clamping arm member 22 will preferably define an arm clamping surface 24 preferably of a concave shape to further facilitate grasping of round or other differently shaped jewelry substrates 12.

The arm clamping surface 24 of the clamping arm member 22 and the base clamping surface 16 of the base plate member 14 will preferably be facing one another and spaced apart somewhat to define therebetween the clamping zone means 30. It is this clamping zone means 30 in which a substrate jewelry member 12 can be positioned such that when the base plate member 14 and the clamping arm member 22 are clasped with respect to one another they will compress the substrate jewelry member 12 within the clamping zone 30 for retaining of ornamentation as desired with respect thereto.

Preferably the clamping arm member 22 or, in some cases, the base plate member 14 will define an ornamentation groove 34 extending therearound. This ornamentation groove will facilitate the positioning of an ornamentation means 46 therein such as stones, decorative gold or any other commonly available jewelry ornamentation apparatus to facilitate the decorative look of the substrate jewelry member 12.

Figure 3:
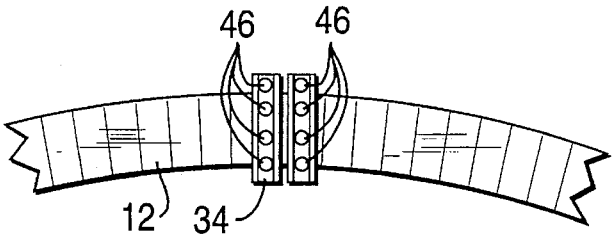
FIG. 3 is a top plan view of the embodiment shown in FIG. 1 displayed attached to a substrate jewelry member.
Figure 4:
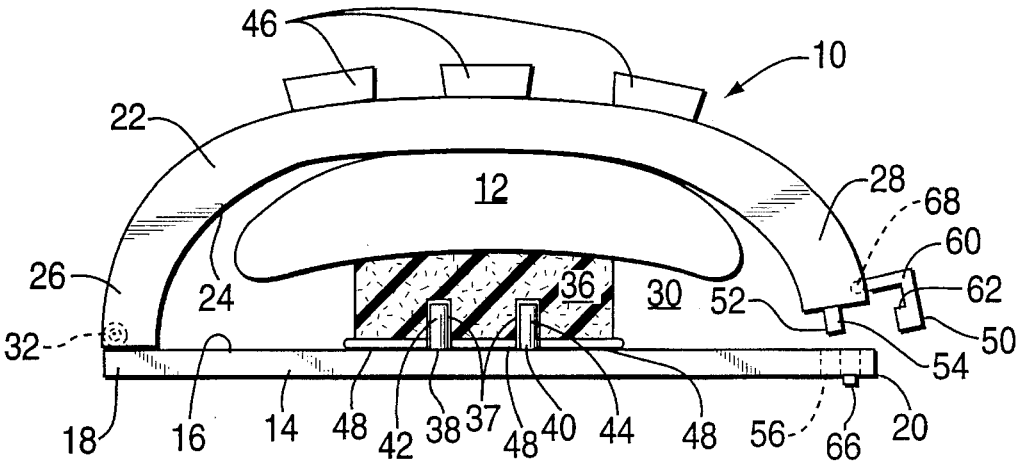
FIG. 4 is a side cross-sectional view of the embodiment shown in FIG. 1 as in position during securement thereof with respect to a substrate jewelry.

To facilitate gripping of the substrate jewelry member 12 within the clamping zone 30 a compression member 36 is preferably positioned in abutment with respect to the base clamping surface 16 of the base plate member 14. Also to further facilitate positioning of the compression member 36 a positioning means 38 is preferably included in the apparatus of the present invention. Such a positioning means 38 preferably takes the form of a post apparatus or means 40 which may include a first post member 42 and a second post member 44 positioned adjacent to one another as shown best in FIGS. 1 and 3. The post members 42 and 44 will preferably extend into poles 37 defined in the undersurface of the compression member 36 to facilitate retainment thereof in the desired position on the base clamping surface 16. The compression member 36 need not include such holes but usage of such holes can be sometimes useful during certain clamping actions, It has been found that the hole means 37 defined in the compression member 36 is not needed in the construction of the apparatus of the present invention and will only be required in certain types of jewelry ornamentation means wherein a further control by the positioning means is deemed necessary.

To facilitate securement of the compression member 36 with respect to the positioning means 38 or the posts 42 and 44 an adhesive 48 may be applied to the posts prior to positioning of the compression member 36 in abutment therewith. This adhesive means 48 can take the form of any type of glue or adhesive or cement in order to prevent displacement or loss of the compression member 36.

To facilitate grasping of a substrate jewelry member 12 positioned within the clamping zone 30 between the base clamping surface 16 and the arm clamping surface 24 in abutment therewith by the compression member 36, a clasping means 50 will preferably be secured with respect to the base plate member 14 and the clamping arm member 22. This clasping means is preferably positioned adjacent the second base plate end 20 and the second clamping arm end 28 and is adapted to bias those two ends closer with respect to one another to thereby compress the compression member 36 in abutment with the substrate jewelry member 12 and thereby detachably affix the jewelry ornamentation means 10 with respect thereto.

In a specific configuration the clasping apparatus preferably includes a primary locking apparatus 52 which includes a primary locking tab 54 extending outwardly from the second clamping arm end 28 of the clamping arm member 22. This primary locking tab 54 is preferably integral and formed of the same material as the clamping arm member 22. The primary locking tab 54 is positioned to be capable of extending into a primary locking slot means 56 defined adjacent the second base plate end 20 of the base clamping surface 16. Primary locking slot 56 preferably is of a tapered configuration in order to facilitate interlocking with the primary locking tab 54.

A secondary locking means 58 may also be included in the overall apparatus defined as the clasping means 50. This secondary locking means 58 will provide an auxiliary or safety latch which will provide backup clasping to the primary locking means described above.

Figure 5:
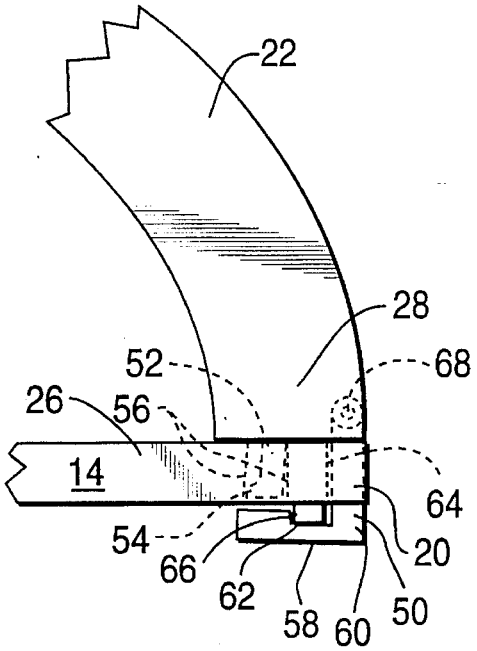
FIG. 5 is a side close-up view of an embodiment of the clasping apparatus of the present invention.
Figure 6:
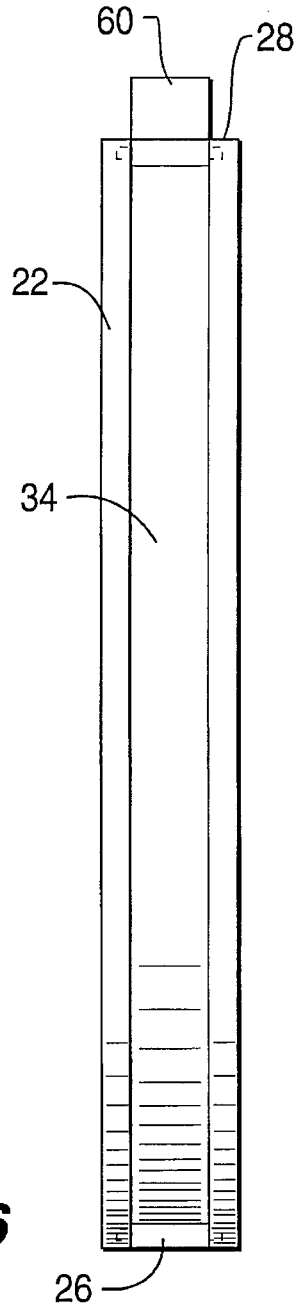
FIG. 6 is a top plan view of an embodiment of the clamping arm member of the present invention showing the ornamentation groove therein.
Figure 7:
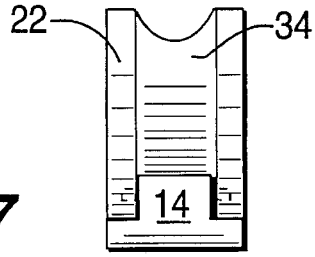
FIG. 7 is a side plan view of the configuration shown in FIG. 5.

In a preferred configuration, the secondary locking apparatus 58 includes an L-shaped bracket member 60 pivotally secured at pivotal connection 68 with respect to the second clamping arm end 28 of the clamping arm member 22. This L-shaped bracket member 60 is adapted to extend through a secondary locking slot 64 defined in the second base plate end 20 of the base plate member 14. Preferably the second locking slot 64 will actually be a slot defined in the outermost end of the second base plate end 20. The L-shaped bracket member 60 will be adapted to extend therethrough and will define a securement notch 62 thereon. This securement notch 62 is adapted to engage a secondary locking shoulder 66 which preferably extends downwardly as shown in FIG. 5 from a position between the primary locking slot 56 and the secondary locking slot 64 in the base plate member 14. With the L-shaped bracket member 60 and in particular the securement notch 62 thereof in engagement with respect to the secondary shoulder means 66 as shown in FIG. 5, an auxiliary interlocking means is provided to augment the primary locking means 52 achieved by interconnection between the primary locking tab 54 and the tapered locking slot 56.

Figure 2:
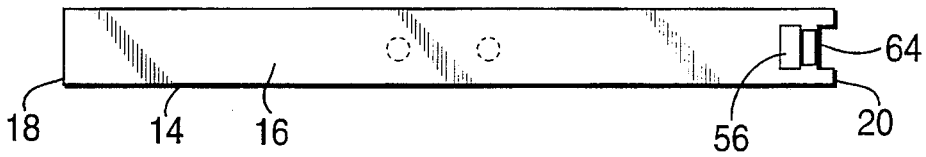
FIG. 2 is a top plan view of an embodiment of the base plate shown in Figure.

In use the jewelry ornamentation means 10 of the present invention can have a great variety of different types of decorative or ornamentation means 46 positioned thereon. The securement of the ornamentation means is enhanced by the ornamentation groove 34 but such a groove is not required. The ornamentation can include additional gold elements, can include gemstones being either precious or semi-precious. Many different types of ornamentations can be used. In fact, multiple jewelry ornamentation member 10 can be utilized with a single substrate jewelry member 12 such as shown in FIG. 2 where two adjacently positioned such ornamentations are utilized.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

We claim:

1. A detachable jewelry ornamentation means, being securable selectively at various locations decoratively with respect to a substrate jewelry member, said detachable jewelry ornamentation means comprising:

A. a base plate member defining a base clamping surface extending therealong and having a first base plate end and a second base plate end spatially disposed from one another;

B. an clamping arm member including a first clamping arm end and a second clamping arm end spatially disposed from one another, said clamping arm member being pivotally attached to said base plate member and further defining an arm clamping surface spatially disposed from and facing said base clamping surface of said base plate member to define a clamping zone means therebetween;

C. a compression member of resiliently flexible material mounted on said base clamping surface within said clamping zone means in order to exert a resilient bias upon a substrate jewelry member positioned within said clamping zone means in order to affix said base plate member and said clamping arm member detachably with respect to the substrate jewelry member as desired; and D. a positioning means affixed to said base clamping surface of said base plate member and in abutment with said compression member for fixedly positioning thereof adjacent said base clamping surface within said clamping zone means to facilitate retainment of a substrate jewelry member therewithin; and E. a clasping means for detachably securing said clamping arm member with respect to said base plate member.

2. A detachable jewelry ornamentation means, being securable selectively at various locations decoratively with respect to a substrate jewelry member, as defined in claim 1 wherein said first clamping arm end of said clamping arm member is pivotally attached with respect to said first base plate end of said base clamping member to facilitate movable attachment therebetween.

3. A detachable jewelry ornamentation means, being securable selectively at various locations decoratively with respect to a substrate jewelry member, as defined in claim 1 wherein said clamping arm member is arcuate to facilitate clamping of a substrate jewelry member positioned within said clamping zone means between said base clamping surface and said arm clamping surface.

4. A detachable jewelry ornamentation means, being securable selectively at various locations decoratively with respect to a substrate jewelry member, as defined in claim 3 wherein said arm clamping surface is concave to further facilitate retaining of a substrate jewelry member thereagainst.

5. A detachable jewelry ornamentation means, being securable selectively at various locations decoratively with respect to a substrate jewelry member, as defined in claim 1 further comprising a primary ornamentation means attachable to said clamping arm member to facilitate ornamentation of the substrate jewelry member.

6. A detachable jewelry ornamentation means, being securable selectively at various locations decoratively with respect to a substrate jewelry member, as defined in claim 5 wherein said clamping arm member defines an ornamentation groove therein to facilitate mounting of said ornamentation means with respect thereto.

7. A detachable jewelry ornamentation means, being securable selectively at various locations decoratively with respect to a substrate jewelry member, as defined in claim 1 wherein further comprising a secondary ornamentation means attachable to said base plate member to facilitate ornamentation of said substrate jewelry member.

8. A detachable jewelry ornamentation means, being securable selectively at various locations decoratively with respect to a substrate jewelry member, as defined in claim 1 wherein said clasping means is adapted to secure said second clamping arm end detachably with respect to said second base plate end to compress said compression member positioned within said clamping zone means therebetween and detachably retain a substrate jewelry member securely therewithin.

9. A detachable jewelry ornamentation means, being securable selectively at various locations decoratively with respect to a substrate jewelry member, as defined in claim 1 wherein said positioning means includes a post means fixedly secured to said base clamping surface of said base plate member and extending outwardly therefrom into said clamping zone means, said post means being protruding into abutment with said compression member for facilitating retaining thereof in position with respect to said base plate member.

10. A detachable jewelry ornamentation means, being securable selectively at various locations decoratively with respect to a substrate jewelry member, as defined in claim 9 wherein said post means includes a first post member and a second post member positioned adjacent to one another and extending outwardly from said base clamping surface into said clamping zone means.

11. A detachable jewelry ornamentation means, being securable selectively at various locations decoratively with respect to a substrate jewelry member, as defined in claim 9 wherein said compression member defining a hole means therein receiving said post means extending therein to facilitate retaining of said compression member secured in position with respect to said base clamping surface.

12. A detachable jewelry ornamentation means, being securable selectively at various locations decoratively with respect to a substrate jewelry member, as defined in claim 1 further including adhesive means positioned between said compression member and said base clamping surface of said base plate member to further maintain securement therebetween.

13. A detachable jewelry ornamentation means, being securable selectively at various locations decoratively with respect to a substrate jewelry member, as defined in claim 1 wherein said clasping means comprises a primary locking means and a secondary locking means.

14. A detachable jewelry ornamentation means, being securable selectively at various locations decoratively with respect to a substrate jewelry member, as defined in claim 13 wherein said primary locking means comprises:

A. a primary locking tab extending outwardly from said clamping arm member; and

B. a primary locking slot means defined in said base plate member and adapted to receive said primary locking tab extending therein to achieve primary locking of said clamping arm member with respect to said base plate member with a substrate jewelry member positioned therebetween within said clamping zone means.

15. A detachable jewelry ornamentation means, being securable selectively at various locations decoratively with respect to a substrate jewelry member, as defined in claim 14 wherein said primary locking slot means is tapered to facilitate detachable securement with respect to said primary locking tab.

16. A detachable jewelry ornamentation means, being securable selectively at various locations decoratively with respect to a substrate jewelry member, as defined in claim 14 wherein said primary locking tab is integrally affixed with said second clamping arm end of said clamping arm member and said primary locking slot means is defined in said base plate member adjacent said second clamping arm end thereof.

17. A detachable jewelry ornamentation means, being securable selectively at various locations decoratively with respect to a substrate jewelry member, as defined in claim 13 wherein said secondary locking means comprises:

A. a bracket member pivotally secured with respect to said second clamping arm end and extending outwardly therefrom; and B. a secondary locking slot means defined in said base plate member adjacent said second base plate end thereof, said bracket member being engageable therethrough to provide said secondary locking means.

18. A detachable jewelry ornamentation means, being securable selectively at various locations decoratively with respect to a substrate jewelry member, as defined in claim 17 wherein said secondary locking means includes a secondary locking shoulder means extending from said base plate member perpendicularly downwardly with respect to said secondary locking slot means and wherein said bracket member defines a securement notch therein being selectively engageable with respect to said secondary locking shoulder means responsive to said bracket member being in position extending through said secondary locking slot means to facilitate detachable securement of said clamping arm member with respect to said base plate member by said secondary locking means.

19. A detachable jewelry ornamentation means, being securable selectively at various locations decoratively with respect to a substrate jewelry member, as defined in claim 18 wherein said bracket member comprises an L-shaped bracket.

20. A detachable jewelry ornamentation means, being securable selectively at various locations decoratively with respect to a substrate jewelry member, said detachable jewelry ornamentation means comprising:

A. a base plate member defining a base clamping surface extending therealong and having a first base plate end and a second base plate end spatially disposed from one another;

B. an clamping arm member including a first clamping arm end and a second clamping arm end spatially disposed from one another, said clamping arm member being pivotally attached to said base plate member and further defining an arm clamping surface spatially disposed from and facing said base clamping surface of said base plate member to define a clamping zone means therebetween, said first clamping arm end of said clamping arm member being pivotally attached with respect to said first base plate end of said base clamping member to facilitate movable attachment therebetween, said clamping arm member being arcuate and said arm clamping surface defined thereon being concave in order to further facilitate retaining of a substrate jewelry member thereadjacent, said clamping arm member defining an ornamentation groove extending therearound to facilitate decoration thereof;

C. a compression member of resiliently flexible material mounted on said base clamping surface within said clamping zone means in order to exert a resilient bias upon a substrate jewelry member positioned within said clamping zone means in order to affix said base plate member and said clamping arm member detachably with respect to the substrate jewelry member as desired, said compression member defining a hole means extending therein;

D. a positioning means affixed to said base clamping surface of said base plate member and in abutment with said compression member for fixedly positioning thereof adjacent said base clamping surface within said clamping zone means to facilitate retainment of a substrate jewelry member therewithin, said positioning means including a post means fixedly secured to said base clamping surface of said base plate member and extending outwardly therefrom into said clamping zone means, said post means being protruding into abutment with said compression member extending into said hole means thereof for facilitating retaining thereof in position with respect to said base plate member, said post means including a first post member and a second post member positioned adjacent to one another and extending outwardly from said base clamping surface into said clamping zone means and positioned extending into said hole means of said compression member;

E. a primary ornamentation means attachable to said ornamentation groove defined in said clamping arm member to facilitate ornamentation of the substrate jewelry member;

F. an adhesive means positioned between said compression member and said base clamping surface of said base plate member to further maintain securement therebetween;

G. a clasping means for detachably securing said clamping arm member with respect to said base plate member, said clasping means being adapted to secure said second clamping arm end detachably with respect to said second base plate end to compress said compression member positioned within said clamping zone means therebetween and detachably retain a substrate jewelry member securely therewithin, said clasping means further including:

(1) primary locking means comprising:

a. a primary locking tab extending outwardly from said clamping arm member and being integrally affixed with said second clamping arm end of said clamping arm member;

b. a primary locking slot means defined in said base plate member adjacent said second clamping arm end thereof, said primary locking slot means adapted to receive said primary locking tab extending therein to achieve primary locking of said clamping arm member with respect to said base plate member with a substrate jewelry member positioned therebetween within said clamping zone means, said primary locking slot means being tapered to facilitate detachable securement with respect to said primary locking tab;

(2) secondary locking means comprising:

a. an L-shaped bracket member pivotally secured with respect to said second clamping arm end and extending outwardly therefrom, said L-shaped bracket member defining securement notch therein;

b. a secondary locking slot means defined in said base plate member adjacent said second base plate end thereof, said L-shaped bracket member being engageable therethrough to provide said secondary locking means; and c. a secondary locking shoulder means extending from said base plate member perpendicularly downwardly with respect to said secondary locking slot means, said securement notch of said L-shaped bracket means being selectively engageable with respect to said secondary locking shoulder means responsive to said L-shaped bracket member being in position extending through said secondary locking slot means to facilitate detachable auxiliary securement of said clamping arm member with respect to said base plate member by said secondary locking means.

* * * * *